US005612767A

United States Patent [19]

Iwama

[11] Patent Number: 5,612,767

[45] Date of Patent: Mar. 18, 1997

[54] IMAGE FORMING DEVICE HAVING AN IMAGE-HOLDING BODY WHICH ROLLS ON A RECORDING SHEET ABOUT AN AXIS PARALLEL TO A CONVEYING DIRECTION OF THE RECORDING SHEET

[75] Inventor: Ryouichi Iwama, Kawasaki, Japan

[73] Assignee: Fujitsu Limited, Kawasaki, Japan

[21] Appl. No.: 429,134

[22] Filed: Apr. 26, 1995

[30] Foreign Application Priority Data

May 16, 1994 [JP] Japan ..... 6-101104

[51] Int. Cl.[6] ..... G03G 15/00; G03G 15/04

[52] U.S. Cl. ..... 399/98; 347/138; 347/242; 399/206

[58] Field of Search ..... 355/30, 215, 229; 347/130, 138, 241, 242, 245, 244; 257/98

[56] References Cited

U.S. PATENT DOCUMENTS

| | | | |
|---|---|---|---|
| 4,277,160 | 7/1981 | Yamada | 355/215 X |
| 4,639,749 | 1/1987 | Ito | 347/130 X |
| 4,780,730 | 10/1988 | Dodge et al. | 347/244 X |
| 4,913,526 | 4/1990 | Hediger | 359/819 |
| 5,376,994 | 12/1994 | Mama et al. | 355/215 |

FOREIGN PATENT DOCUMENTS

| | | |
|---|---|---|
| 56-077167 | 6/1981 | Japan . |
| 61-152463 | 7/1986 | Japan . |
| 62-147472 | 7/1987 | Japan . |
| 1-262569 | 10/1989 | Japan . |
| 3-132777 | 6/1991 | Japan . |
| 3-219272 | 9/1991 | Japan . |
| 3-221473 | 9/1991 | Japan . |
| 4-166824 | 6/1992 | Japan . |

*Primary Examiner*—Arthur T. Grimley
*Assistant Examiner*—Sophia S. Chen
*Attorney, Agent, or Firm*—Staas & Halsey

[57] ABSTRACT

An image forming device includes a conveying unit for conveying a recording sheet in a predetermined direction, a light-exposure unit for forming an image on an image-holding body by using light, which image-holding body rolls on the recording sheet by rotating around an axis parallel to the predetermined direction, so that the image on the image-holding body is transferred onto the recording sheet, and an adjustment unit for adjusting an angle of the light-exposure unit relative to the axis, so that the image on the image-holding body can be aligned with the axis.

10 Claims, 15 Drawing Sheets

IMAGE FORMING DEVICE HAVING AN IMAGE-HOLDING BODY WHICH ROLLS ON A RECORDING SHEET ABOUT AN AXIS PARALLEL TO A CONVEYING DIRECTION OF THE RECORDING SHEET

BACKGROUND OF THE INVENTION

1. Field of the Invention

The present invention generally relates to image forming devices and, more particularly, relates to an image forming device which prints out information on a recording sheet by making a latent image on a recording drum.

In recent years, electrophotographic printers of a serial type have been developed, which type carries an electrophotographic process unit on a carriage for printing information. This development was made in order to meet a demand for miniaturization and lower pricing of electrophotographic recording devices. These printers of the serial type duplicate an image onto a recording sheet using an image-transfer unit by running the carriage in a direction perpendicular to a direction in which the recording sheet is fed, or advanced. However, the recently developed such printers require further refinement and improvement in printed-image qualities.

2. Description of the Prior Art

FIG. 1 shows a cross-sectional view of an electrophotographic recording device 10 of the prior art and which includes a photosensitive drum 11, an electrification unit 12, an optical scanning unit 13, a developing unit 14, an image-transfer unit 15, a discharging unit 16, a cleaner 17, an image-fixing unit 18, and sheet conveying units 19*a* and (which comprise drive rollers). Also, the electrophotographic recording device 10 is provided at one side thereof with a predetermined number (two in this example) of sheet supplying units 21*a* and 21*b* storing recording sheets 20, and at the other side with a stacker 22 which stacks the recording sheets 20 into a pile, or stack.

The photosensitive drum 11 is at least as wide as the recording sheets 20, and has an axis of rotation 11*a*, which is perpendicular to a direction in which the recording sheets 20 are fed, or advanced. The developing unit 14 is filled with toner 14*a*, and has a developing roller 14*b*, which touches (i.e., contacts) the photosensitive drum 11 to form a toner image thereon. The photographic image-fixing unit 18 includes fixing rollers 18*a* and 18*b* with a heat source 23 being provided inside the fixing roller 18*b*.

FIG. 2 shows an isometric view of an optical system employed in the electrophotographic recording device 10 of FIG. 1. In FIG. 2, the optical system includes a semiconductor laser 24, a collimator lens 25, a diaphragm 26, a cylindrical lens 27, a polygon mirror 28, a toric lens 29, and an f-Θ lens 30. A laser light beam emitted by the semiconductor laser 24 is reflected by the polygon mirror 28 after passing through the collimator lens 25, the diaphragm 26, and the cylindrical lens 27, so as to be scanned on the photosensitive drum 11. The light beam reflected by the polygon mirror passes through the toric lens 29 and the f-Θ lens 30 before reaching the photosensitive drum 11.

When there is a dispersion error on a reflectance surface of the polygon mirror 28, timing variations are created in writing information by scanning a laser beam on the photosensitive drum 11. As a counter-measure for this, at a beginning of each scan corresponding to each reflectance surface, a timing detection sensor 33 receives the laser beam, as reflected by a fixed mirror 31 via a beam-condensing lens 32. Also, when there is an error in the positioning of the polygon mirror 28 with regard to an angle of its rotation axis, a variation is created in the location on the photosensitive drum 11 of the laser beam. The toric lens 29, which is asymmetric with regard to its rotation, is used for correcting the error.

In the electrophotographic recording device 10 of FIG. 1, the photosensitive drum 11 is electrified by the electrification unit 12, and is illuminated by the laser beam coming from the optical scanning unit 13. In this manner, a latent image is recorded on the photosensitive drum 11 as a pattern of different voltage levels. The developing unit 14 attaches the toner 14*a* on the photosensitive drum 11 holding the latent image, so that a visible toner image is created thereupon.

The conveying rollers 19*a* and 19*b* lead (i.e., advance) the recording sheet 20 into a gap between the photosensitive drum 11 and the image-transfer unit 15, whereby the recording sheet 20 comes in contact with the surface of the photosensitive drum 11. The toner image on the photosensitive drum 11 is transferred onto the recording sheet 20 by the image-transfer unit 15. Then, the recording sheet 20 with the toner image thereupon is clamped by the fixing roller 18*a* and the fixing roller 18*b*, as heated to a predetermined temperature by the heat source 23, so that the toner image is fixed on the recording sheet 20.

FIG. 3 shows an isometric view of another optical system. In FIG. 3, an LED (light-emitting diode) array 34 comprised of LEDs arranged in a line is used as a light-exposure device. The LED array 34 is supplied with on/off signals for a scanning purpose, whereby the LEDs which are supplied with an on-signal emit light. Thus, a parallel scan can be realized.

Light beams emitted by the LED array 34 are condensed by a SELFOC lens 35 so as to write information on the photosensitive drum 11. Here, each of the LEDs emitting light constitutes one pixel in an image pattern. This optical system does not include mechanical elements which might affect precision in positioning the light beam. However, in order to adjust a diameter of the condensed light beam and light energy applied on the photosensitive drum 11, a distance between emitting surfaces of the LED array 34 and points of writing information on the photosensitive drum 11 should be measured.

There is a type of the electrophotographic recording devices, which type can control a position of an LED head, such as the LED array and the SELFOC lens, in relation to the photosensitive drum. Thereby the focusing of the light beam can be adjusted. Such a device is disclosed in the Japanese Laid-Open Patent Application No. 62-147472.

Also, there is a serial type of the electrophotographic printers, which type carries an electrophotographic process on a carriage in order to print information by rotating a photosensitive drum in a direction along the width of the recording sheet.

FIGS. 4A and 4B show a plan view of part of a serial-type electrophotographic printer and a cross-sectional view of a carriage of FIG. 4A, respectively.

In FIGS. 4A and 4B, a serial-type electrophotographic printer 41 disclosed in Japanese Laid-Open Patent Application No. 61-152463 includes conveying rollers 43*a* and 43*b*, which convey a recording sheet 42. The serial-type electrophotographic printer 41 also includes a shaft 44 parallel to respective axes of the conveying rollers 43*a* and 43*b*, and a carriage 45, which is movable in a direction along the width of the recording sheet 42 (perpendicular to the direction of conveying the recording sheet 42) . The movement of the carriage 45 is guided by the shaft 44 and driven by a motor (not shown). The serial-type electrophotographic printer 41 also includes an image-fixing unit 46 fixed in a predetermined position, which has a width wider than that of the recording sheet 42. There is an image-transfer unit 47 provided beneath the recording sheet 42, as shown in FIG. 4B.

The carriage´45 includes an image-holding body 51, an electrification unit 52, a light-exposure unit (an LED array and a lens) 53, a developing unit 54, toner 55, and a developing roller 56. The image-holding body 51 rotates at a speed corresponding to movement of the carriage 45. A surface of the image-holding body 51 is electrified by the electrification unit 52, and the light-exposure unit 53 forms a latent image of static charge on that surface. The latent image of static charge is turned into a visible toner image by the developing roller 56 of the developing unit 54 attaching the toner 55 on the above-mentioned surface. The toner image on the surface of the image-holding body 51 is transferred to the recording sheet 42 by the image-transfer unit 47 opposing the image-holding body 51 through the recording sheet 42. The image transferred onto the recording sheet 42 is fixed by the image-fixing unit 46.

In the serial-type electrophotographic printer 41 as described above, the rotation rate of the image-holding body 51 must be in accordance with the moving speed of the carriage 45. Thus, the rotation rate can become quite large in order to realize a practical printing speed.

For example, assume that it takes 30 seconds (2 pages per minute) for printing out one page of the recording sheet 42 having an A4 size (similar size to the legal paper size). Also, assume that a diameter of the image-holding body 51 is as small as 24 mm because of the demand for the miniaturization of the device, and that one page includes 10 lines with intervals between characters in one line being 28 mm. Then, a time length which can be used for one line is 3 seconds (30 seconds divided by 10 lines). Further, assume the carriage 45 uses 2 seconds for printing characters and 1 second for returning to the start point of a next line. Then, if a recording area in one line is 210 mm, the rotation rate of the image-holding body 51 must be equivalent to a speed of 105 mm/sec.

For the printer to be improved, of course, higher speed printing should be realized.

In the serial-type electrophotographic printer, a returning operation at a time of moving from one line to the next line must be accurate. Thus, correction is carried out for the returning operation with regard to a primary scanning direction P and a secondary scanning direction S. Accuracy in the secondary scanning direction S is dictated by the accuracy of conveying the recording sheet. Thus, the correction with regard to the secondary scanning direction S can be easily realized by adjusting a number of steps for the rotation of the conveying motor.

FIGS. 5A and 5B show illustrative drawings for explaining a displacement in the primary direction P. As shown in FIGS. 5A and 5B, when the light-exposure unit 53 is mounted at an angle to the image-holding body 51, the bottom one of the dots arranged along the width of one line is displaced relative to the top one of the dots in the primary scanning direction P. Thus, a displacement X is generated between one line and the next line. For example, in order for the displacement X to seem to be within one-dot precision to human vision, the displacement X must be smaller than half a dot in effect. Thus, when a resolution is 200 dpi, the displacement X must be smaller than 0.0635 mm.

The displacement X is mainly generated by a variation between different dots in a light-emitting line of the light-exposure unit 53 and by a variation in the positioning of the light-exposure unit 53. These variations are difficult to adjust, thus creating a problem of a degraded printing quality caused by the displacement.

The electrification unit 52 and the developing roller 56 must be rotated at almost the same rate as that of the image-holding body 51. However, a high rotation rate of the electrification unit 52 and the developing roller 56 results in the toner 53 being not completely attached on the image-holding body 51. Thus, some of the toner 53 ends up flying around the image-holding body 51.

The flying toner can become attached to the light-exposure unit 53 so as to create under-exposure. The light-exposure unit 53 cannot be placed at a sufficient distance from the image-holding body 51 because of the demand for the miniaturization. Also, the printer cannot be thoroughly cleaned by users for removal of the toner attached on the light-exposure unit 53. This also adds to the problem of degraded printing quality.

Further, the image-holding body 51 is a photosensitive drum formed of an organic photoconductive (OPC) material or amorphous silicon. The use of the amorphous silicon is preferable to the OPC material because a photosensitive surface thereof which receives energy of the light exposure should drop in the voltage level thereon at a fast enough rate so as to be ready for the development of a latent image.

However, an OPC material is generally used for a photosensitive drum because of the demand for a lower price. Such a photosensitive drum is typically rotated at 50 mm/sec, such as in the printer of FIG. 1. This creates problems of a shorter life of the photosensitive drum, an insufficient density of blackness, coloring of a background, and a degraded printing quality.

Further, adjustment of the focusing of light-exposure units 34, 35, and 53 must be conducted in the printers of FIG. 1 and FIG. 4. However, the adjustment of the focusing in accordance with a method disclosed in the Japanese Laid-Open Patent No.62-147472 on the page No.3 and in the figure No.3 thereof requires a number of repeated adjustments based on repeated checks on printing qualities. Thus, this method is actually difficult to carry out, leading to a degraded printing quality.

Accordingly, there is a need in the field of electronic photographic printers for a serial-type electronic photographic printer which has an improved printing quality.

SUMMARY OF THE INVENTION

Accordingly, it is a general object of the present invention to provide a serial-type electrophotographic printer which can satisfy the needs described above.

It is another and more specific object of the present invention to provide a serial-type electrophotographic printer which has an improved printing quality.

In order to achieve the above objects according to the present invention, an image forming device includes a conveying unit for conveying a recording sheet in a predetermined direction, a light-exposure unit for forming an image on an image-holding body by using light, which image-holding body rolls on the recording sheet by rotating about an axis of rotation parallel to the predetermined direction, so that the image on the image-holding body is transferred onto the recording sheet, and an adjustment unit for adjusting an angle of the light-exposure unit relative to the axis so that the image on the image-holding body can be aligned with the axis.

In the device according to the present invention, the adjustment means can adjust an angle of the light-exposure means so as to eliminate displacements between successive lines, each of which is recorded on the recording sheet by rolling the image-holding body thereon. Thus, the printing quality can be improved.

In order to achieve the above objects in a different manner from that above-described according to the present invention, an image forming device includes a conveying unit for conveying a recording sheet in a predetermined direction, a light-exposure unit for forming an image onto an image-holding body by using light, which image-holding body rolls on the recording sheet by rotating about an axis of rotation parallel to the predetermined direction, so that the image on the image-holding body is transferred onto the recording sheet, and a cleaning unit for cleaning the light-exposure unit by contacting a surface emitting the light.

In the above-described device of the present invention, the cleaning means can be moved to rub the surface of the light-exposure means, so that dirt on the light-exposure means, caused by the high-speed printing, can be removed. Thus, the printing quality can be improved.

In order to achieve the above objects in a different manner from those above-described according to the present invention, an image forming device includes a conveying unit for conveying a recording sheet in a predetermined direction, a light-exposure unit for forming an image onto an image-holding body by using light, which image-holding body rolls on the recording sheet by rotating about an axis of rotation parallel to the predetermined direction, so that the image on the image-holding body is transferred onto the recording sheet, and correction members inserted at a time of positioning the light-exposure unit relative to the image-holding body so that a focal point of the light can be placed on the image-holding body.

In the above-described device of the present invention, the number of correction members inserted at the time of positioning the light-exposure means can be adjusted so that the focal point of the light emitted by the light-exposure means can be readily placed on the surface of the image-holding body. Thus, the printing quality can be improved.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
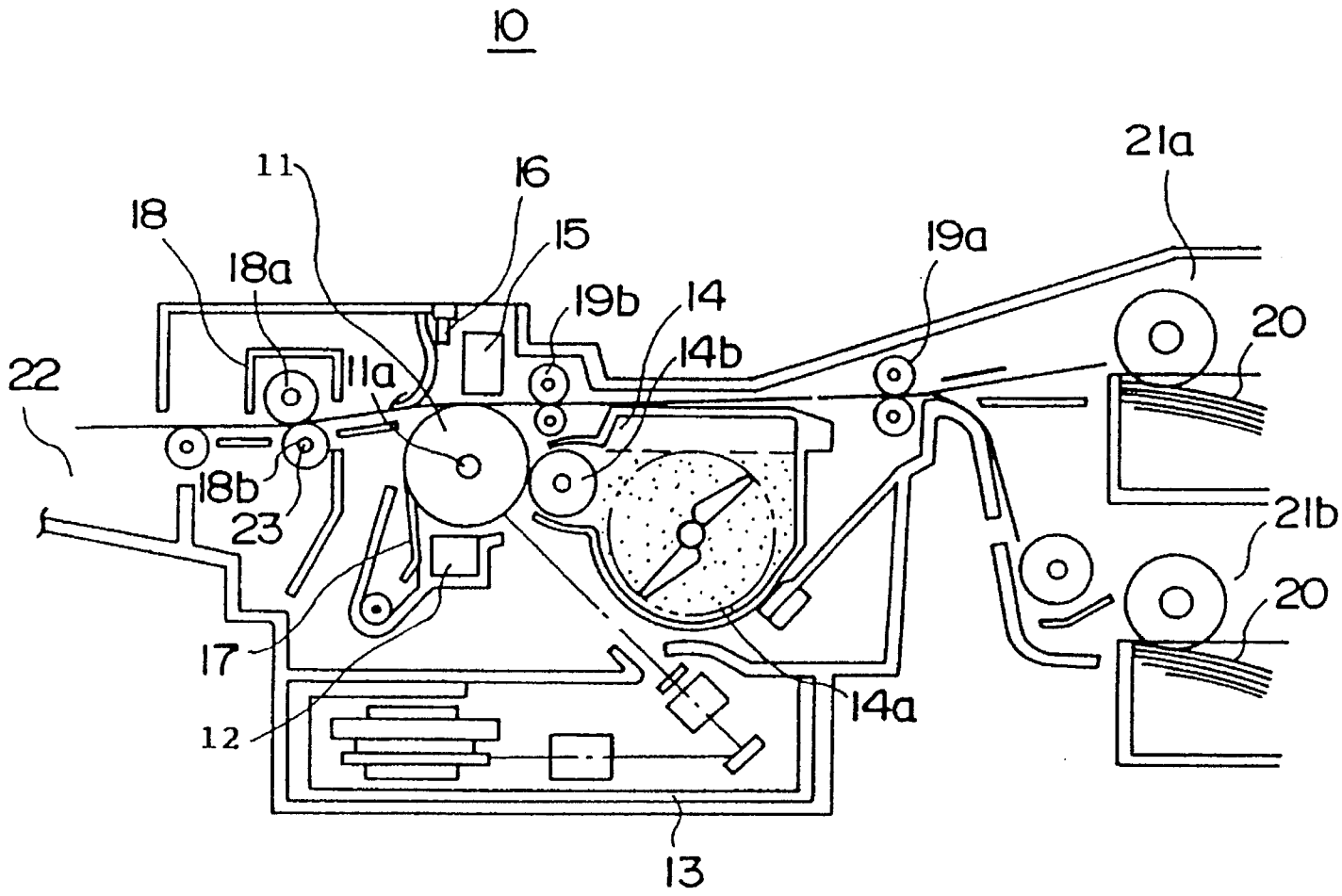
FIG. 1 PRIOR ART
FIG. 1 is a cross-sectional view of an electrophotographic recording device of the prior art.
Figure 2:
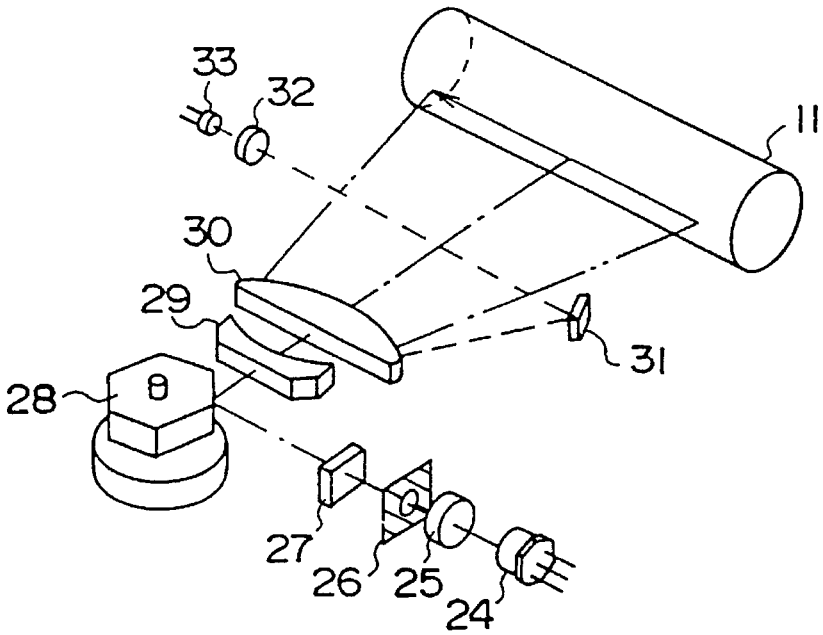
FIG. 2 PRIOR ART
FIG. 2 is an isometric view of an optical system of the prior art.
Figure 3:
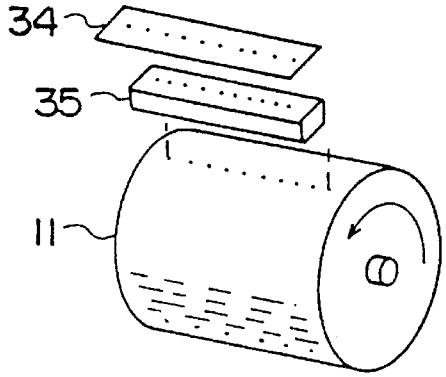
FIG. 3 PRIOR ART
FIG. 3 is an isometric view of another optical system of the prior art.
Figure 4A:
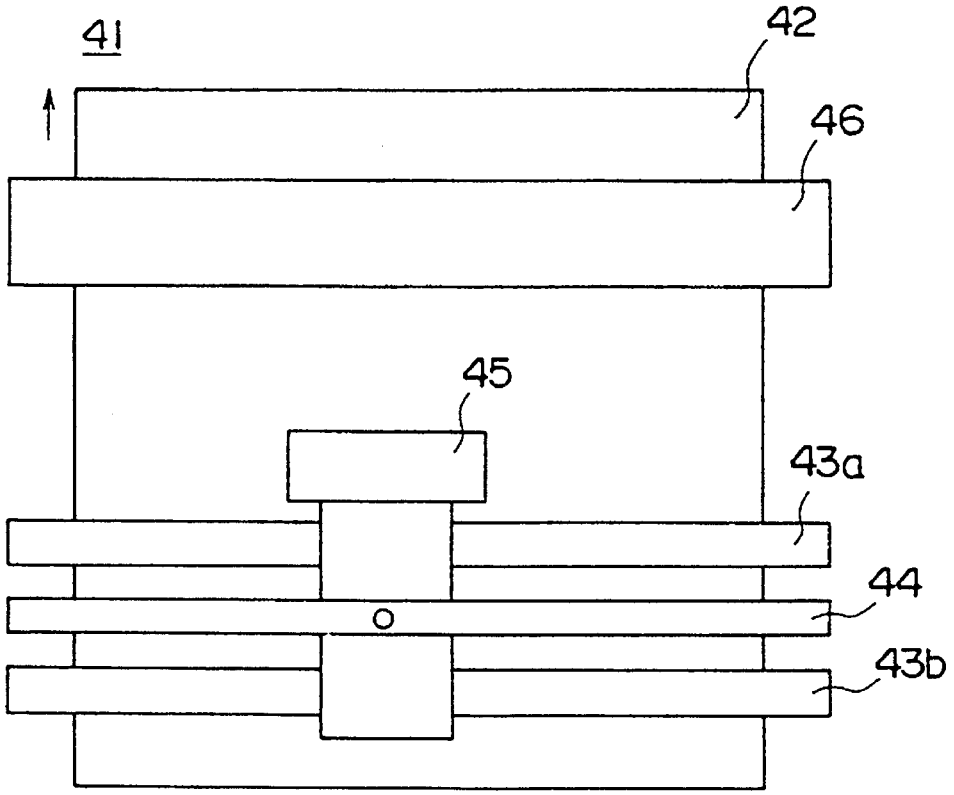
FIG. 4A PRIOR ART
FIGS. 4A and 4B are a plan view and a cross-sectional view, respectively, of part of a serial-type electrophotographic printer of the prior art.
Figure 4B:
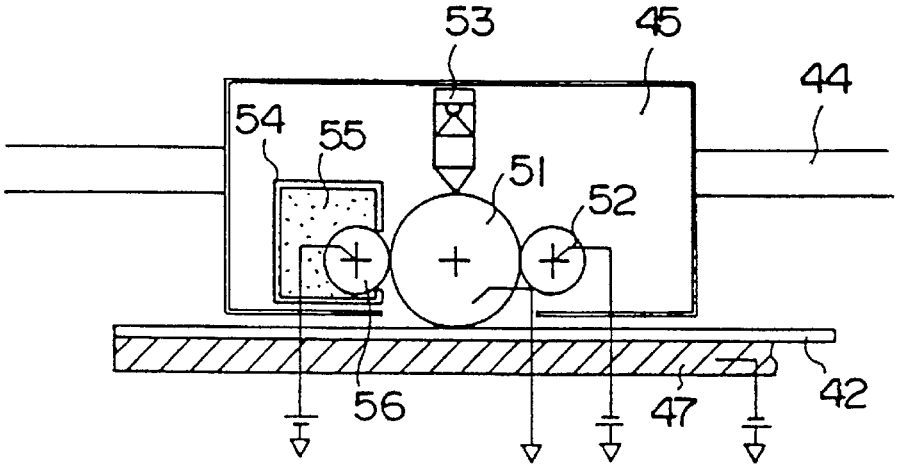
FIG. 4B PRIOR ART
Figure 5A:
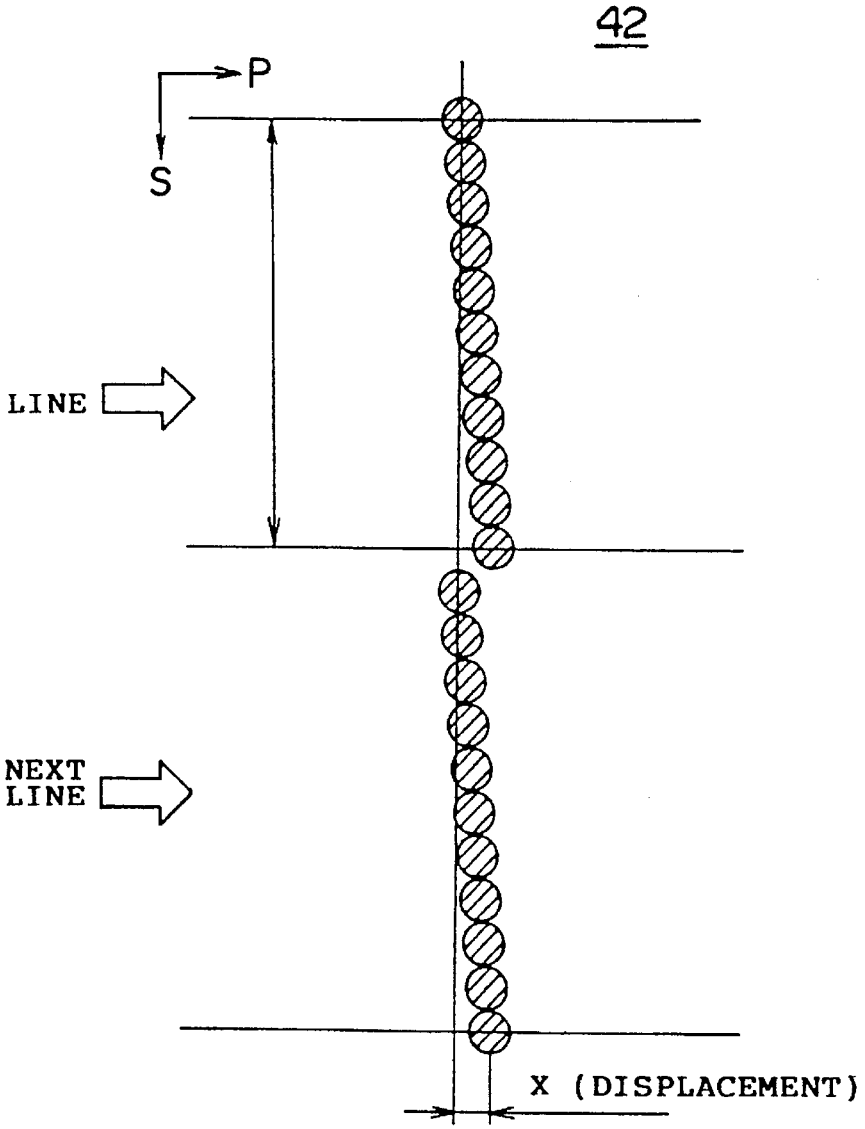
FIGS. 5A and 5B are illustrative drawings for explaining a displacement generated between two successive lines.
Figure 5B:
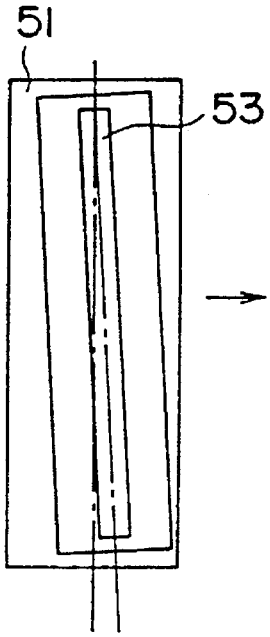
Figure 6A:
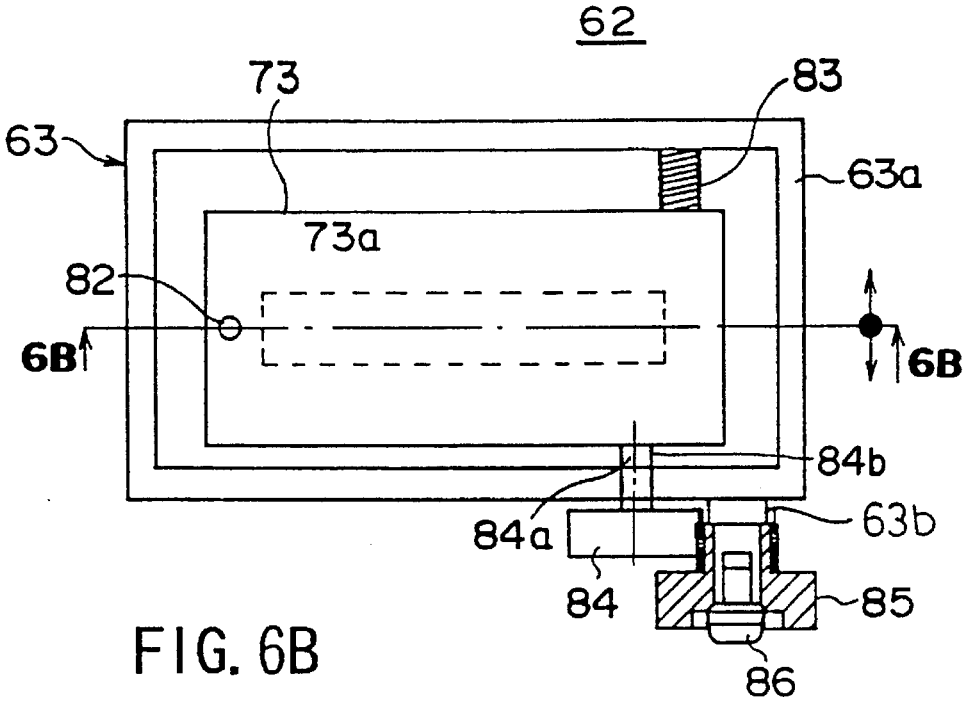
FIGS. 6A and 6B are a sectional plan view and a cross-sectional view, respectively, of a carriage of a serial-type electrophotographic printer according to a first principle of the present invention.
Figure 6B:
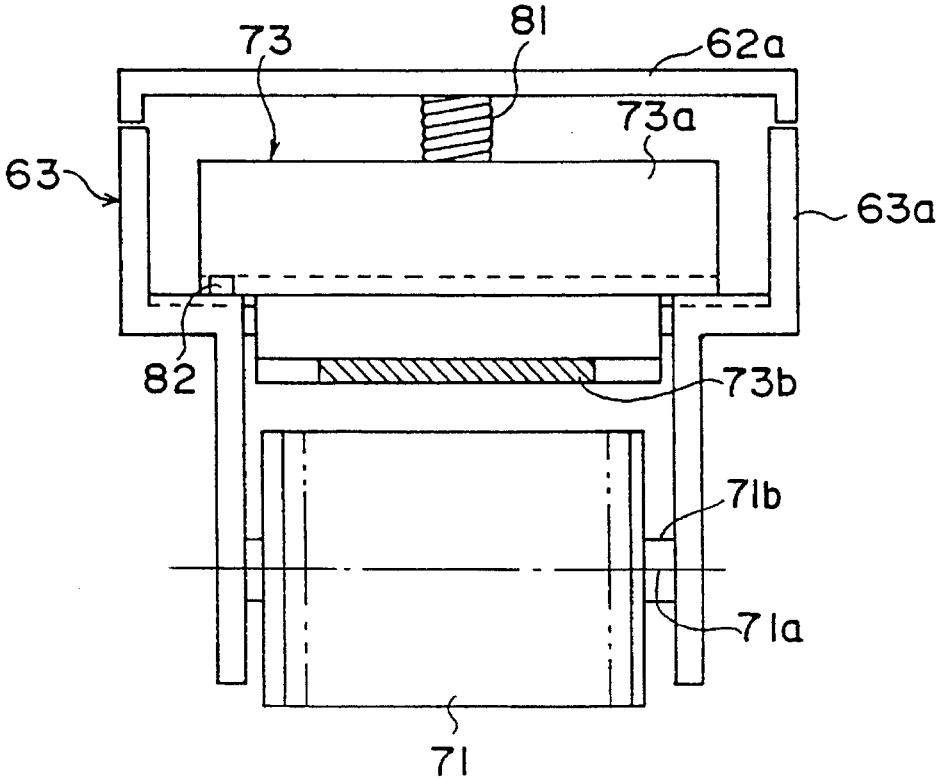

FIGS. 6A and 6B show a configuration of a first embodiment of the present invention. FIGS. 6A and 6B are, respectively, a sectional plane view and a cross-sectional view, taken along a line 6B—6B of FIG. 6A, of a process unit 63 provided for a carriage 62 of a serial-type electrophotographic printer $\mathbf{61}_A$. The serial-type electrophotographic printer $\mathbf{61}_A$ is an example of an image forming device according to the present invention.

In FIGS. 6A and 6B, the process unit 63, provided for the carriage 62, includes a process frame 63*a*, a recording drum 71, and a light-exposure unit 73. The recording drum 71 is a rotatable image-holding body mounted inside the process frame 63*a*. The light-exposure unit 73 is comprised of an LED head positioned over the recording drum 71. The light-exposure unit 73 includes an LED array unit 73*a* and a SELFOC lens 73*b*. The LED array unit 73*a* is a light source unit comprised of a predetermined number of LEDs arranged in a line. The SELFOC lens 73*b* is a lens of a distributed-refraction-indexes type serving to condense light.

The light-exposure unit 73 is urged downwardly by a spring (or a leaf spring) 81 connected to the carriage 62. Also, the light-exposure unit 73 is mounted to the process frame 63*a* by means of a pin 82 so as to be rotatable in a horizontal plane which is parallel to a rotation axis 71*a* of a shaft 71*b* of the recording drum 71.

Also, the light-exposure unit 73 is urged on one side, at an end opposite the pin 82 and in a direction corresponding to the rotation by a spring (or a leaf spring) 83 connected to the process frame 63*a*. The light-exposure unit 73 is stopped on the other side by a shaft 84*b*, having a rotation axis 84*a*, of a gear 84, which can rotate to move in a direction of the rotation of the light-exposure unit 73. Thus, a position of light-exposure unit 73 can be regulated by the gear 84. The rotation axis 84*a* of the gear 84 is screwed into a hole provided through the process frame 63*a*, and an adjustment gear 85, engaged with the gear 84, is mounted by a screw 86 on a stud 63*b* formed on the process frame 63*a* so as to be rotatable. The spring 83, the gear 84, and the adjustment gear 85, together form an angle adjustment device.

Figure 7A:
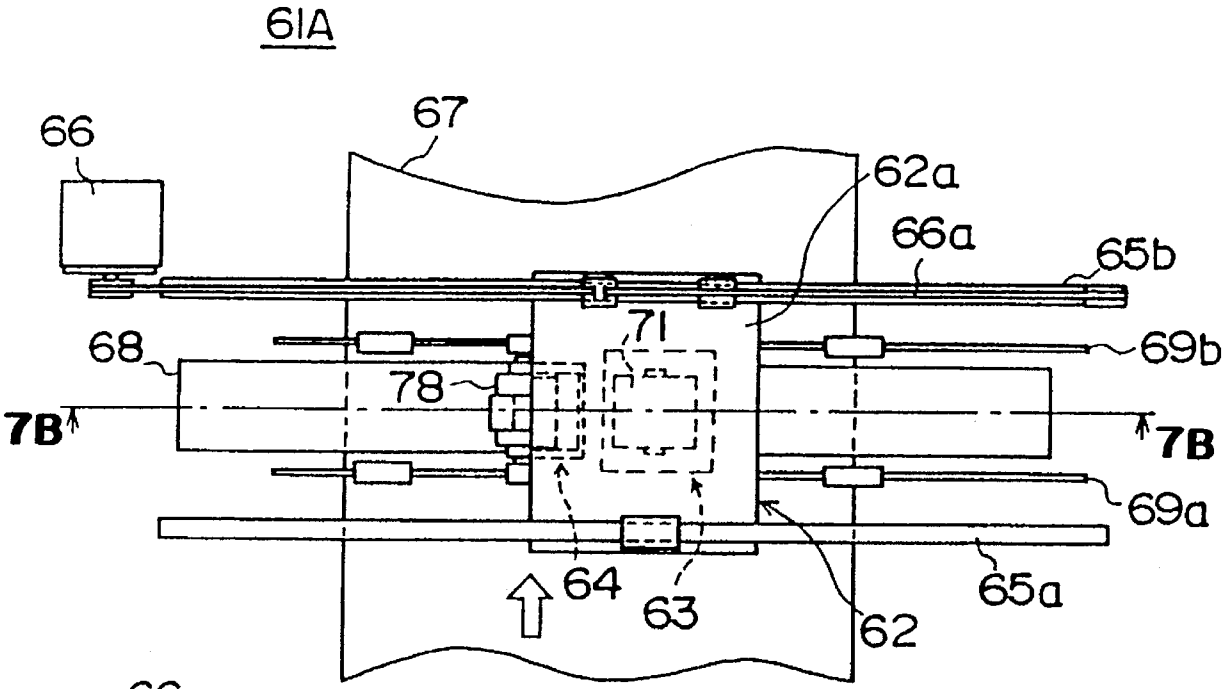
FIGS. 7A and 7B are a plan view and a cross-sectional view, respectively, of a main part of the serial-type electrophotographic printer of the first embodiment.
Figure 7B:
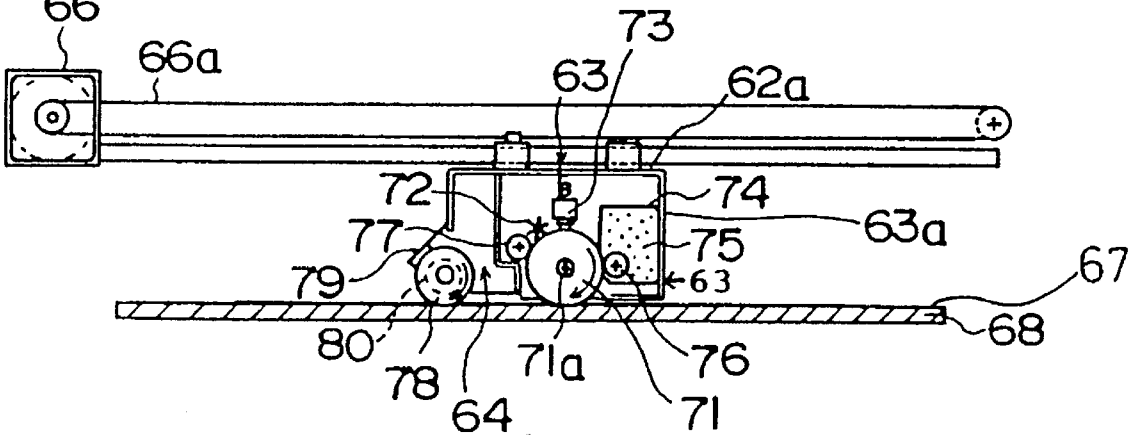

FIGS. 7A and 7B show a plan view and a cross-sectional view, respectively, of the serial-type electrophotographic printer 61A of the first embodiment. In FIG. 7A, the serial-type electrophotographic printer $\mathbf{61}_A$ includes the carriage 62, the process unit 63, an image-fixing unit 64, guide shafts 65*a* and 65*b*, a carrier motor 66 and a belt 66*a*, for conveying a recording sheet 67. The carriage 62, carrying the process unit 63 and the image-fixing unit 64, is guided by the guide shafts 65*a* and 65*b*. The carriage 62 is moved by the carrier motor 66 in a direction perpendicular to a direction of conveying the recording sheet 67.

The photographic printer 61A further includes an image-transfer unit 68 and conveying rollers 69*a* and 69*b*. The image-transfer unit 68 is positioned between the guide shafts 65*a* and 65*b* so as to extend in a direction of the movement of the carriage 62. The conveying rollers 69*a* and 69*b* are provided on both sides of the image-transfer unit 68 so as to extend in the same direction. The conveying rollers 69*a* and 69*b* are used for conveying the recording sheet 67 in a direction shown by an arrow.

The image-transfer unit 68 has a shape of a board formed from aluminum and the like. A heat-resistant conductive member such as silicon rubber containing a conductive material is formed on a surface of the board facing the carriage 62.

FIG. 7B shows a cross-sectional view taken along a line 7B—7B in FIG. 7A. As shown in FIG. 7B, the carriage 62 is comprised of the process unit 63 and the image-fixing unit 64 held on a holding body 62*a*. A recording drum 71, as an image-holding body, is provided in the process unit 63, and has a rotation axis 71*a* parallel to the direction of conveying the recording sheet 67. The recording drum 71 rolls on the recording sheet 67 over the image-fixing unit 64 at a rate corresponding to the movement of the carriage 62.

A surface of the recording drum 71 is electrified uniformly by the electrification unit 72, and a latent image of static charge is formed on the surface by the light-exposure unit 73. The latent image of static charge is turned into a visible toner image by a developing roller 76 attaching toner 75 contained in a developing unit 74. The toner image on the recording drum 71 is transferred to the recording sheet 67 when a predetermined voltage level is applied between the image-transfer unit 68 and the recording drum 71. Here, the developing roller 76 is rotated at the same rate as the rotation of the recording drum 71.

The recording drum 71 is discharged after the toner image thereupon is transferred to the recording sheet 67. Then, remaining toner is scraped off (i.e., removed) from the recording drum 71 by a cleaner 77.

The image-fixing unit 64 includes an image-fixing roller 78 and a thermistor 79 for detecting a temperature of the fixing roller 78, so that the temperature can be controlled. The fixing roller 78 is provided with a halogen lamp 80 therein for generating heat. Both ends of the halogen lamp 80 are contacted by nodes, to which an electric power is applied.

With reference to FIGS. 6A and 6B again, assume that the rotation axis 84*a* of the gear 84 moves 0.2 mm during one rotation thereof, and that a gear ratio of the gear 84 to the adjustment gear 85 is 4. Then, one rotation of the adjustment gear 85 results in the movement of the rotation axis 84*a* of the gear 84 being 0.05 mm.

Accordingly, the light-exposure unit (LED head) 73 can be rotated about the pin 82 by moving the shaft 84*b*, by rotation about the rotation axis 84*a* of the gear 84 through the adjustment gear 85. That is, an LED line of the LED array unit 73*a* of the light-exposure unit 73 can be adjusted with regard to its angle relative to the direction of the rotation axis 71*a* of the recording drum 71.

In this manner, the displacement which is observed between successive lines can be removed by the adjustment.

After an angle of the LED line is adjusted, the adjustment gear 85 is fixed by the screw 86. In doing so, the adjustment gear 85 may be slightly rotated. But the adjustment of the LED line is not affected much, because of the large gear ratio of the gear 84 to the adjustment gear 85.

In this manner, a variation between different dots in the light-emitting line of the LED array unit 73*a* of the light-exposure unit 73 or a variation in the positioning of the LED array unit 73*a* can be readily adjusted to remove the displacement appearing between lines. Thus, the printing quality can be improved.

Figure 8A:
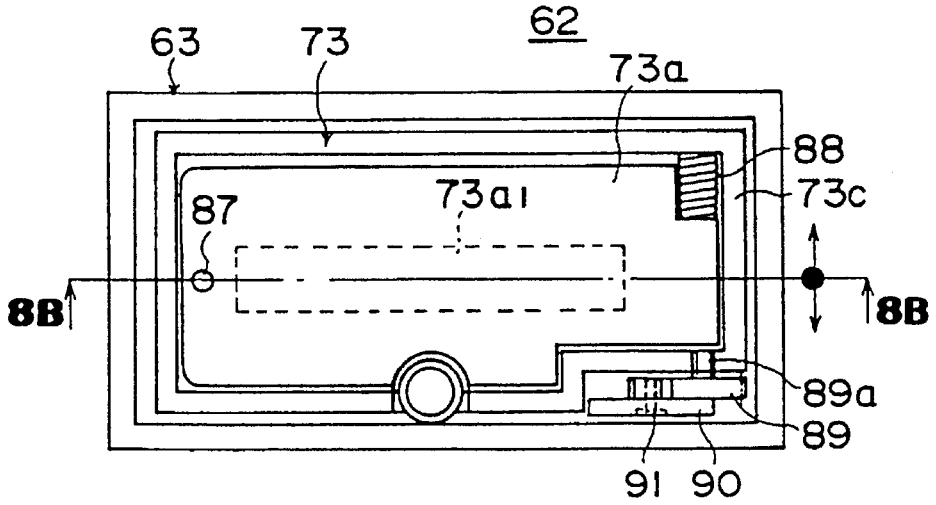
FIGS. 8A and 8B are a sectional plan view and a cross-sectional view, respectively, of another example of the first embodiment.
Figure 8B:
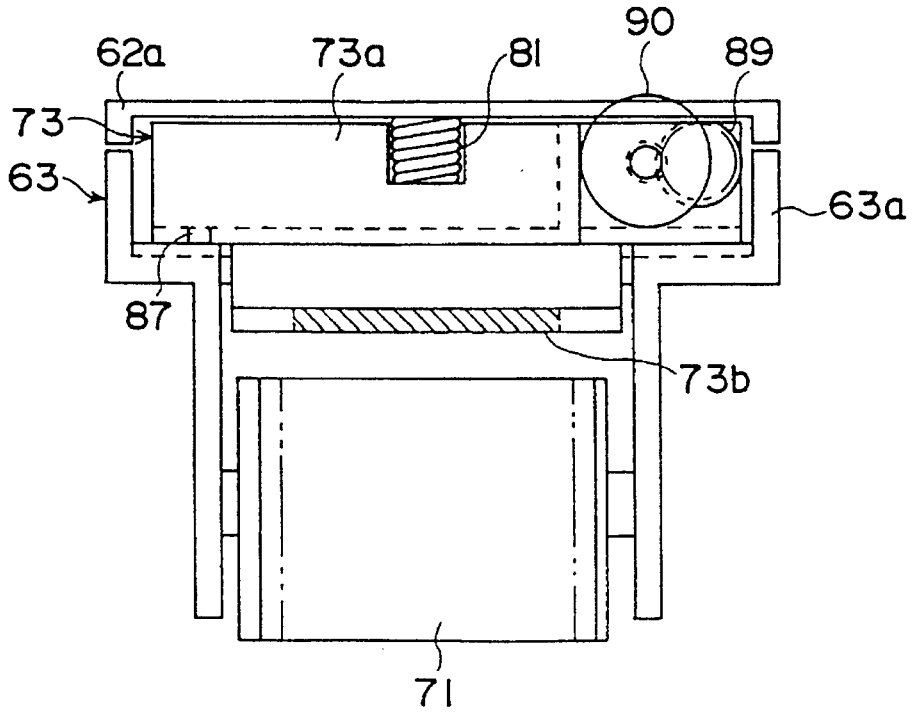

FIGS. 8A and 8B show a sectional plan view and a cross-sectional view along line 8B—8B in FIG. 8A, respectively, of another example of the first embodiment. In FIGS. 8A and 8B, the light-exposure unit (LED head) 73 is urged toward the recording drum 71 by the spring 81 connected to the holding body 62*a*.

The LED array unit 73*a* having an LED array $\mathbf{73}a_1$ is mounted to a light-exposure frame 73*c* by means of a pin 87 formed on the light-exposure frame 73*c*, so as to be rotatable. The LED array unit 73*a* is urged on one side, at an end opposite the pin 87, by a spring 88 connected to the light-exposure frame 73*c*. The other side of the LED array unit 73*a* is stopped by a shaft 89*b*, having a rotation axis 89*a*, of a gear 89 which can rotate and move in a direction corresponding to the rotation of the LED array unit 73*a*. Thus, the positioning of the LED array unit 73*a* is regulated by the gear 89. The shaft 89*b*, having the rotation axis 89*a*, of the gear 89 is screwed into a hole provided through the light-exposure frame 73*c*, and an adjustment gear 90 contacting with the gear 89 is mounted by a screw 91 on the light-exposure frame 73*c*. The spring 88, the gear 89, and the adjustment gear 90, together, form an angle adjustment device.

In FIGS. 6A and 6B, the light-exposure unit 73 including the LED array unit 73*a* and the SELFOC lens 73*b* is rotated by the gear 84 and the adjustment gear 85. On the other hand, in FIGS. 8A and 8B, only the LED array unit 73*a* is rotated by the gear 89 and the adjustment gear 90 in a direction shown by an arrow, in order to adjust the angle of the printing line. A mechanism shown in FIGS. 8A and 8B can also improve the printing quality in the same manner as that shown in FIGS. 6A and 6B.

Although not shown in the figures, a mechanism in which only the SELFOC lens 73*b* is rotated while the LED array unit 73*a* is fixed can have the same effect on the adjustment of the printing line.

Figure 9A:
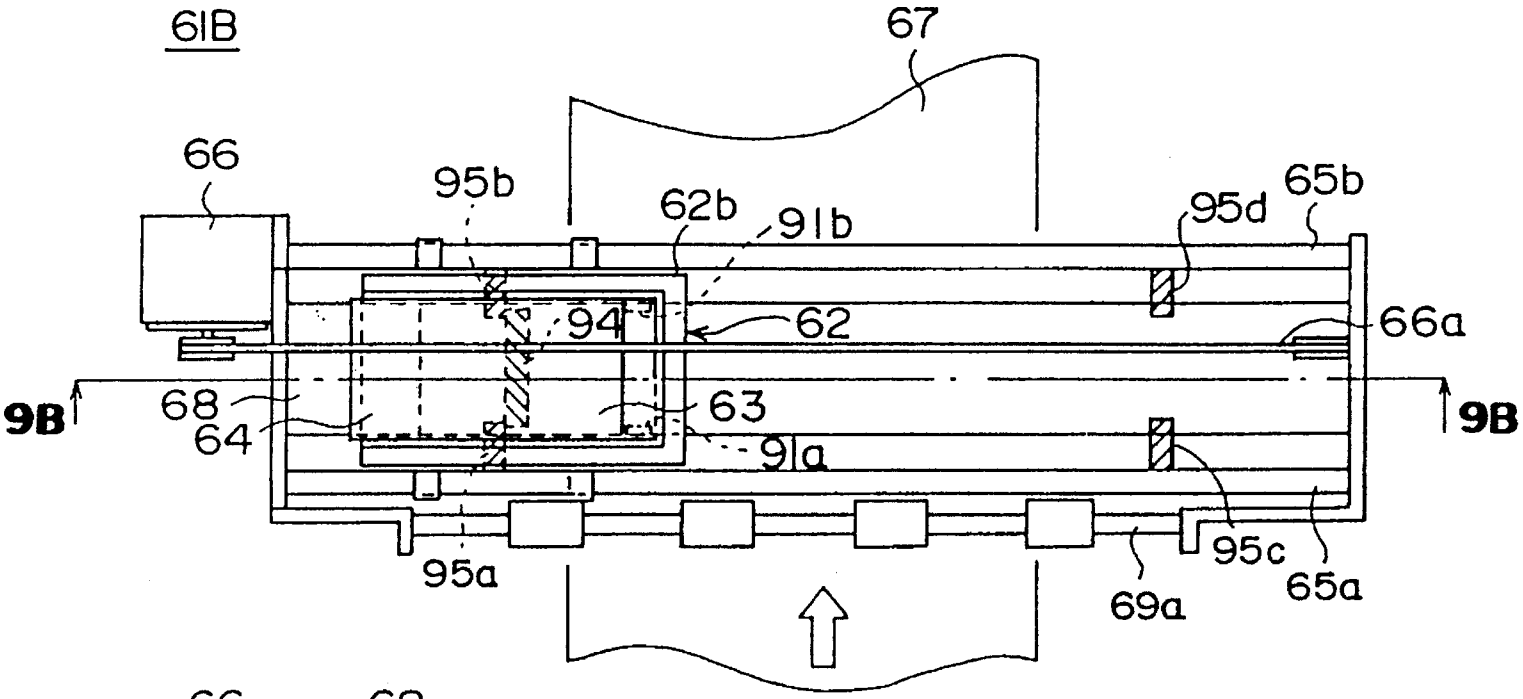
FIGS. 9A and 9B are a plan view and a cross-sectional view, respectively, of a main part of a serial-type electrophotographic printer according to a second embodiment of the present invention.
Figure 9B:
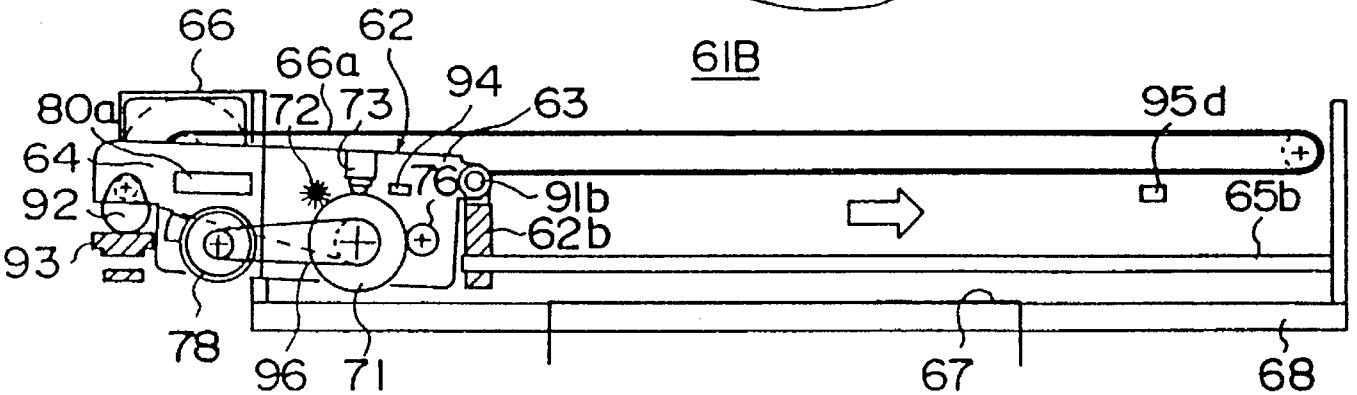

FIGS. 9A and 9B show a plane view and an A—A cross-sectional view, respectively, of a second embodiment of the present invention. The same elements as those of FIGS. 7A and 7B are referred by the same numerals, and a description thereof will be omitted.

In a serial-type electrophotographic printer 61B of FIGS. 9A and 9B, the carriage 62 guided by the guide shafts 65*a* and 65*b* is moved by the carriage motor 66 in a direction perpendicular to a direction of conveying the recording sheet 67. The carriage 62 includes the process unit 63 and the image-fixing unit 64 integrally formed, and is mounted to the sliding member 62*b* by means of pins 91*a* and 91*b* so as to be rotatable.

The image-fixing unit 64, provided on the carriage 62 on a side nearer to the starting position of printing, is equipped with an eccentric cam 92. The eccentric cam 92 engages a stop unit 93 formed on the sliding member 62*b*. The eccentric cam 92 is rotated on the stop unit 93 by a driving motor (not shown), and lifts up (i.e., raises) and retracts (i.e., lowers) the carriage 62 by rotation about the pins 91*a* and 91*b*, acting as fulcrums. The eccentric cam 92 and the stop unit 93 together form a retracting device.

The process unit 63 includes the recording drum 71 having a surface formed from a photosensitive layer of amorphous silicon, the light-exposure unit 73 comprised of the LED array unit 73*a* and the SELFOC lens 73*b*, and the developing roller 76. Also, the process unit 63 includes a cleaning member (e.g., felt) 94, which extends in a direction along the length of the SELFOC lens 73*b* and has a length longer than an effective light-exposure area. The cleaning member 94 constitutes a cleaning device, and is mounted on a movable plate 94*a* (shown in FIG. 11) so as to be able to contact a surface of the SELFOC lens 73. A gap between the SELFOC lens 73*b* and the recording drum 71 (not shown) has a length of L, and the cleaning member 94 can be moved in this gap. Other parts of configuration are the same as FIGS. 7A and 7B, and description thereof will be omitted.

The image-fixing unit 64 includes the fixing roller 78 and a heating unit 80*a* such as an induction heating coil provided nearby the fixing roller 78. In the figure(s), such components as a thermistor, etc., for controlling the temperature of the fixing roller 78 are omitted for the sake of clarity.

At a predetermined position on the guide shafts 65*a* and 65*b* along a direction of the movement of the carriage 62, hook units 95*a* and 95*b* are provided, respectively. Also, other hook units 95*c* and 95*d* are provided at a print-end position. The hook units 95*a* and 95*b* hook, at that predetermined position, the movable plate 94*a* bearing the cleaning member 94, so that the cleaning member 94 can be moved as the carriage 62 moves.

A sensor (not shown) is provided to detect the top end of the recording sheet 67 conveyed by the conveying roller 65*a*. The recording drum 71 and the fixing roller 78, which are connected by a belt 96, are rotated in accordance with the movement of the carriage 62.

Figures 10A, 10B, 10C:
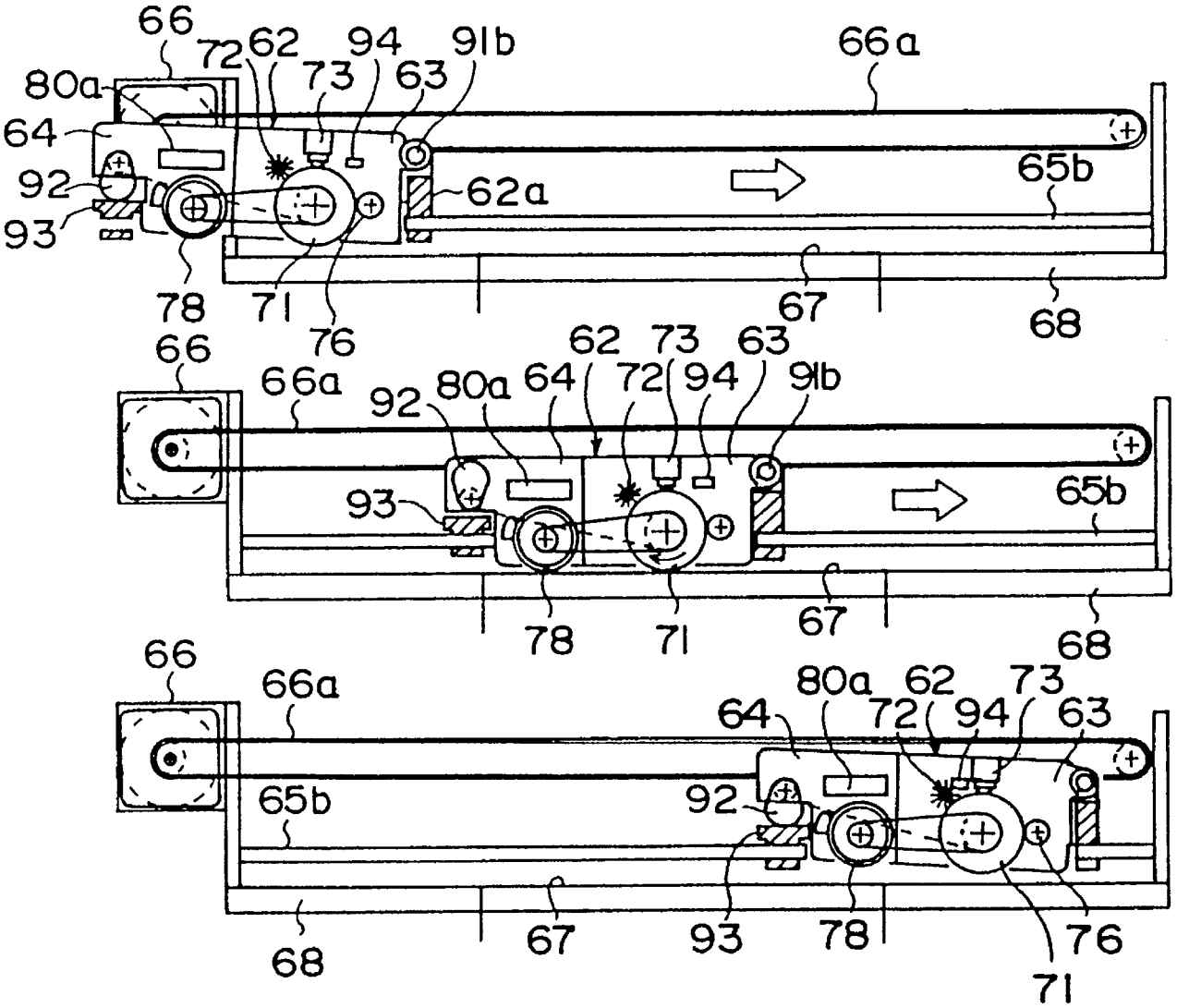
FIGS. 10A through 10C are cross-sectional views of the main part of FIGS. 9A and 9B.

FIGS. 10A though 10C show cross-sectional views of the second embodiment, and are used for explaining an operation of the second embodiment. FIG. 10A shows a state in which the carriage 62 is positioned at a home position. In this state, the carriage 62 is being raised, by rotation about the fulcrum, i.e., the pins 91*a* and 92*b*, by the eccentric cam 92 rotating on the stop unit 93. Thus, the recording drum 71 and the fixing roller 78 are in a retracted position.

FIG. 10B shows a state in which the carriage 62 has been moved in a direction, shown by arrows in FIGS. 10A and 10B, until the recording drum 71 is moved to a starting position of the printing on the recording sheet. Here, the top end of the recording sheet is detected by the sensor. In this state, the eccentric cam 92 is rotated so as to release the carriage 62 from the retracted position. Thus, the carriage 62, as it moves, can print information on the recording sheet 67 by using the recording drum 71, and fix the information by using the fixing roller 78.

FIG. 10C shows a state in which the carriage 62 has been further moved until the fixing roller 78 is positioned at the end position of printing on the recording sheet. In this state, the eccentric cam 92 is rotated on the stop unit 93 so as to rotate the carriage 62 about the pins 91*a* and 91*b*. Thus, the carriage 62 is raised to the retracted position. The carriage 62 then returns to the home position.

In this manner, the carriage is in the retracted position during a return to the home position, so that an after (i.e., a retained) image remaining on the recording drum 71 and the toner attached on the fixing roller 78 do not taint the recording sheet 67. This leads to printing quality being improved.

Figure 11A:
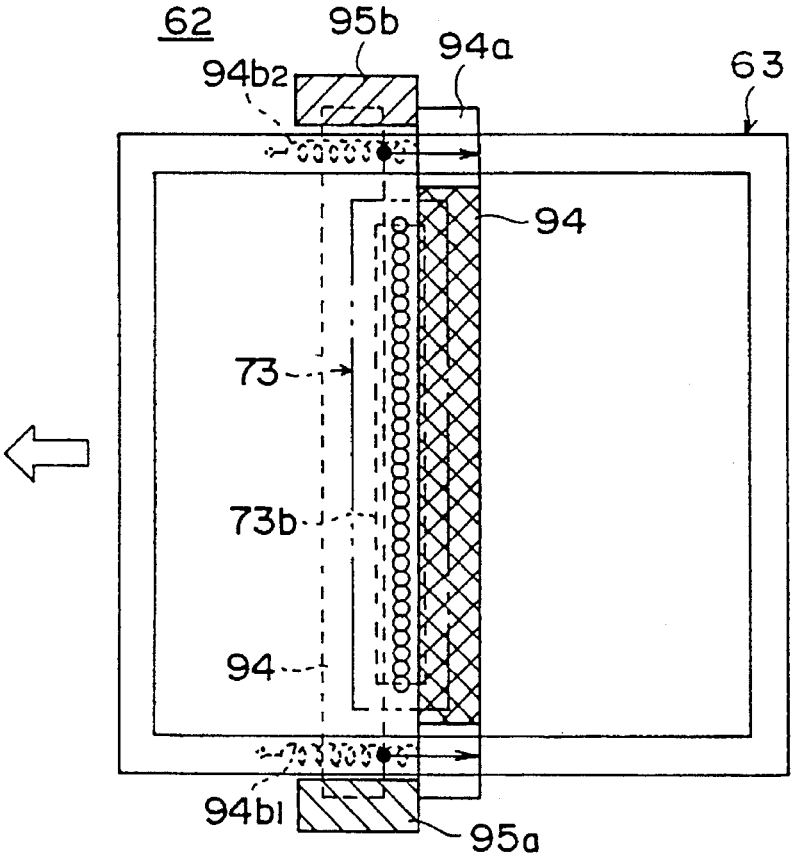
FIGS. 11A and 11B are a plan view and a cross-sectional view, respectively, of the second embodiment for explaining an operation of a cleaning unit of FIGS. 9A and 9B.
Figure 11B:
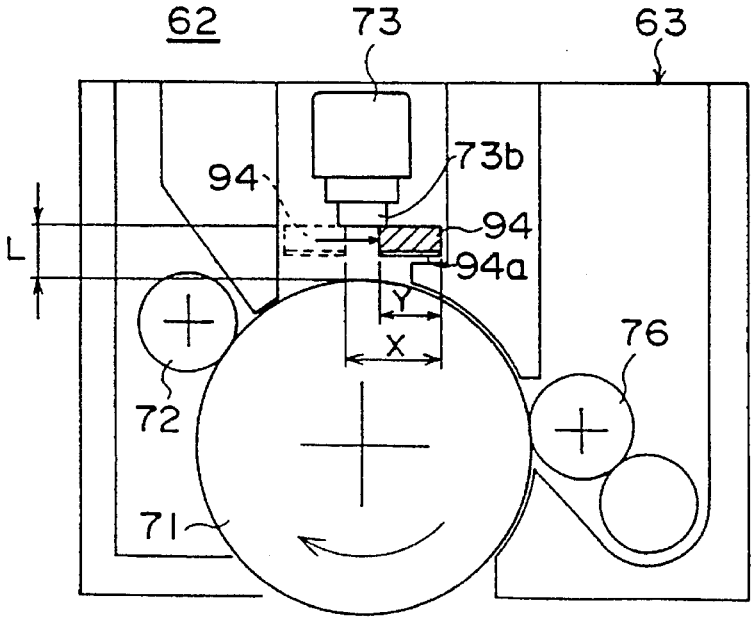

FIGS. 11A and 11B and FIGS. 12A and 12B show a cleaning operation of the second embodiment. FIGS. 11A and 11B show a sectional plan view and a cross-sectional view of part of the carriage 62, and show a state in which the carriage 62 is returning to the home position. At an instant immediately before the carriage 62 reaches the home position, both ends of the movable plate 94*a* come in contact with the hook units 95*a* and 95*b*. This contact moves the movable plate 94*a* inside the carriage 62 in a direction opposite to the returning direction of the carriage 62. At this instance, the cleaning member 94 on the movable plate 94*a* rubs a surface of the SELFOC lens 73*b* of the light-exposure unit 73 so as to clean the surface.

As seen in FIG. 11B, an amount of shift X of the movable plate 94*a* is sufficient if it is equal to a width Y of the cleaning member 94 plus a width of the SELFOC lens 73*b*.

Figure 12A:
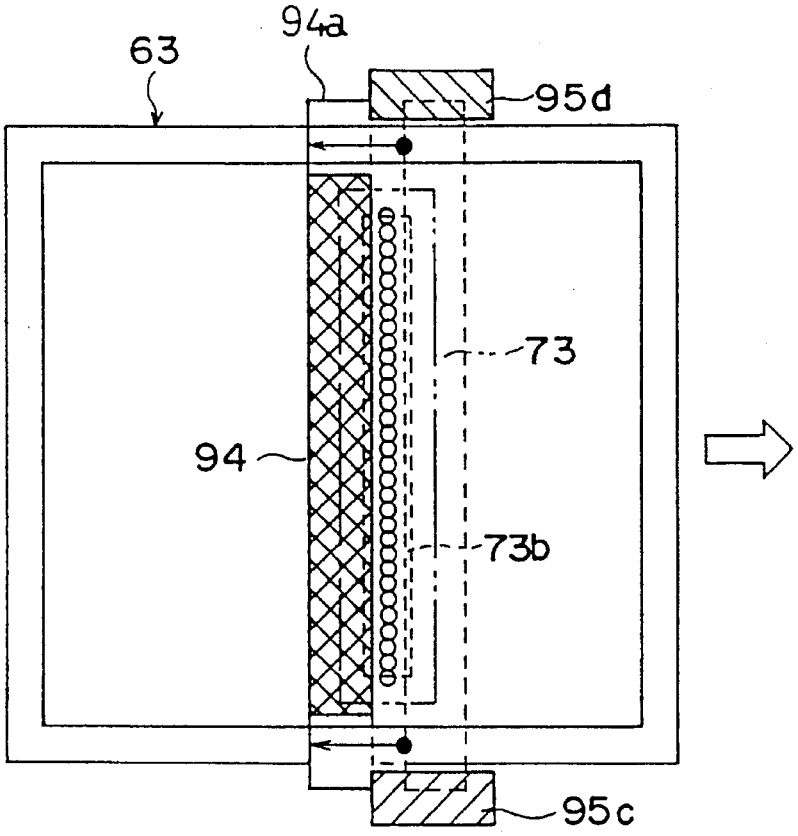
FIGS. 12A and 12B are a plan view and a cross-sectional view, respectively, of the second embodiment for explaining an operation of the cleaning unit of FIGS. 9A and 9B.
Figure 12B:
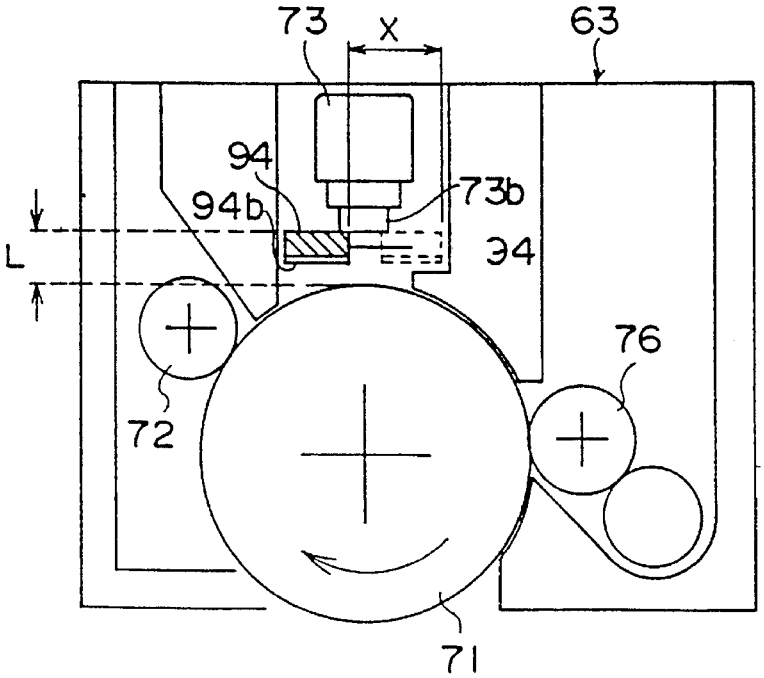

FIGS. 12A and 12B show a sectional plan view and a cross-sectional view of a part of the carriage 62, and show a state in which the carriage 62 is about to reach the print-end position. At an instant immediately before the carriage 62 reaches the print-end position, both ends of the movable plate 94*a* come into contact with the hook units 95*c* and 95*d*. This contact moves the movable plate 94*a* inside the carriage 62 in a direction opposite the forward direction of movement of the carriage 62. At this instance, the cleaning member 94 on the movable plate 94*a* cleans a surface of the SELFOC lens 73*b*.

In this manner, a simple configuration can realize the cleaning of the SELFOC lens 73*b* with the cleaning member 94, each time the carriage moves along a print line. This leads to an elimination of the underexposure owing to dirt on the SELFOC lens 73*b*, and, thus, to printing quality being improved. That is, the dirt on the SELFOC lens 73*b*, which resulted from the toner being flung by the high-speed rotation of the recording drum 71, is cleaned twice each line by the carriage 62 going (advancing) and coming back (returning). Thus, printing quality can be improved even when the printing is carried out at a high speed.

Another example of the second embodiment is also shown in FIG. 11A, and has only the hook units 95*a* and 95*b* on a side of the home position, without the hook units 95*c* and 95*d* on a side of the print-end position. In FIG. 11A, the movable plate 94*a* is provided with springs 94*b*1 and 94*b*2. When the carriage 62 returns to the home position, the movable plate 94*a* is moved by the hook units 95*a* and 95*b*. Then, when the carriage 62 is moved at a time of printing, the movable plate 94*a* is returned to its original position by the springs 94*b*1 and 94*b*2. Thus, the SELFOC lens 73*b* can be cleaned twice at the home position.

Figure 13A:
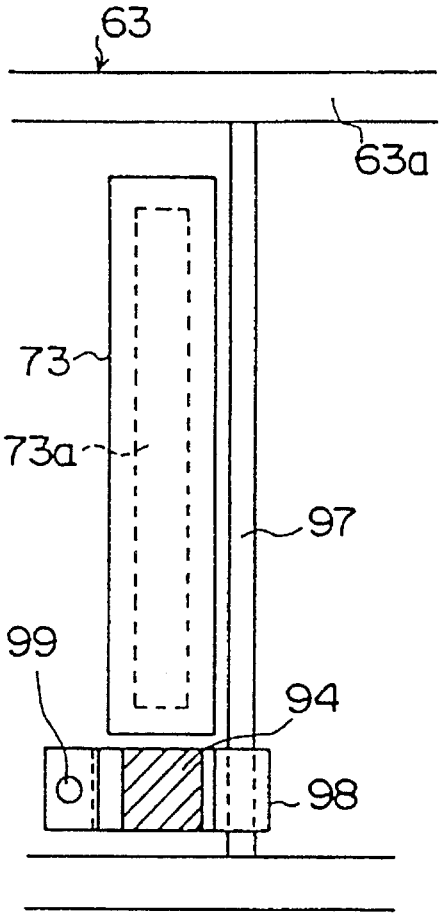
FIGS. 13A and 13B are a plan view and a cross-sectional view, respectively, of another example of the second embodiment.
Figure 13B:
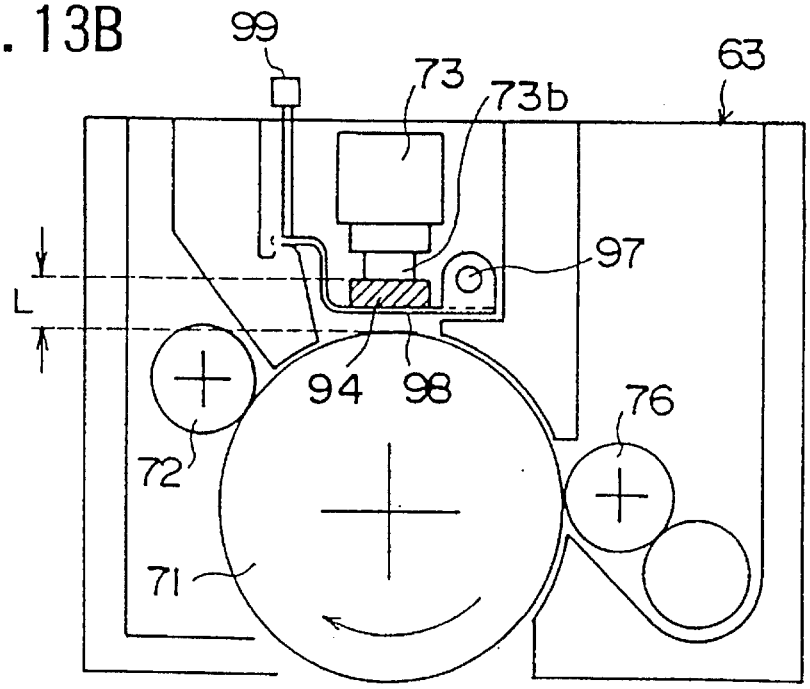

FIGS. 13A and 13B show yet another example of the second embodiment. FIGS. 13A and 13B show a plan view of the light-exposure unit and a cross-sectional view of the process unit, respectively. In FIGS. 13A and 13B, a process frame 63*a* of the process unit 63 is provided with a shaft 97, which extends in a direction of the length of the light-exposure unit 73, located in its proximity. A sliding unit 98 is slidingly supported on the shaft 97 so as to be movable along the shaft 97. A cleaning member 94 having a width as wide as the width of the SELFOC lens 73*b* is provided on the sliding unit 98 at such a height that the cleaning member 94 can touch the SELFOC lens 73*b*. A lever 99 is provided on one end of the sliding unit 98, and extends to the outside of the process unit 63.

An operator moves the lever 99 in the longitudinal direction of the SELFOC lens 73*b* when the carriage 62 is in a stationary state. This makes the cleaning member 94 clean the surface of the SELFOC lens 73*b*, thus improving the printing quality.

The sliding unit 98 may be driven by a motor at a predetermined timing, instead of being manually moved.

Figure 14:
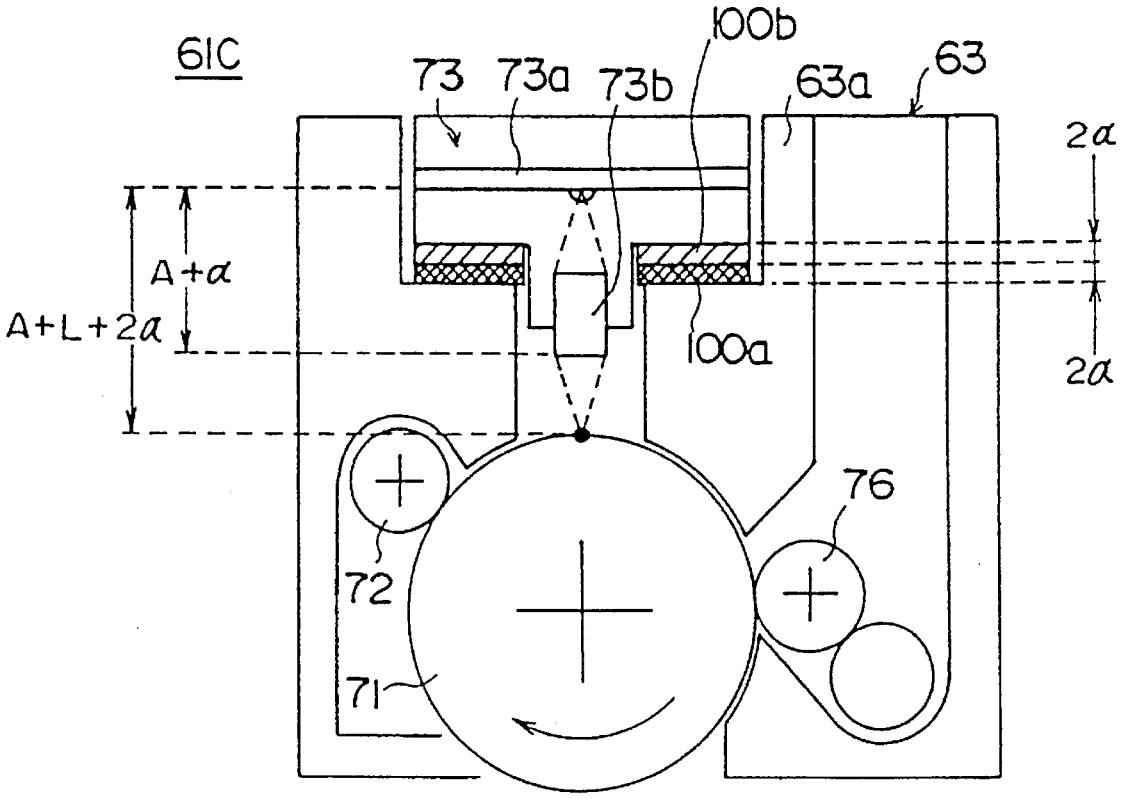
FIG. 14 is a cross-sectional view of a main part of a serial-type electrophotographic printer according to a third embodiment of the present invention.

FIG. 14 is a cross-sectional view of a third embodiment, showing the process unit 63 provided on the carriage 62 of a serial-type electrophotographic printer 61*c*. In FIG. 14, the process unit 63 includes the recording drum 71 and the light-exposure unit 73 which is comprised of the LED array unit 73*a* and the SELFOC lens 73*b*, as described in the previous embodiments. In the third embodiment, a predetermined number (two in the figure) of correction members 100*a* and 100*b* are inserted between the light-exposure unit 73 and the process frame 63*a* at a time of mounting the former to the latter, in order to adjust focusing of the SELFOC lens 73*b* on the recording drum 71.

A thickness of each of the correction members 100*a* and 100*b* is denoted by $\alpha$, realizing a total thickness of the correction members 100*a* and 100*b* to be $2\alpha$. A distance between the SELFOC lens 73*b* and the recording drum 71 is denoted by L. Configurations of other parts are the same as in FIG. 7.

Figure 15A:
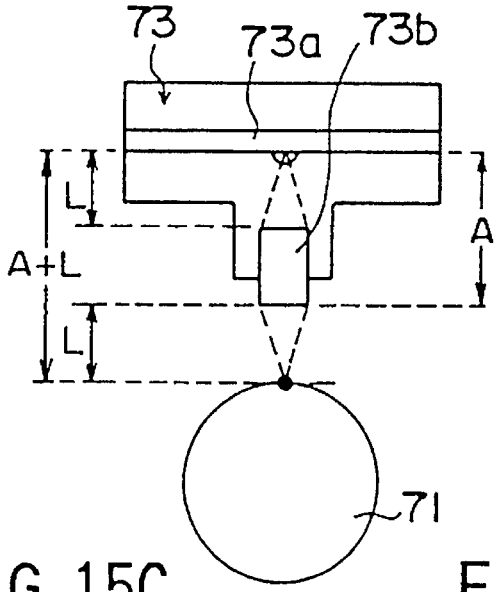
FIGS. 15A through 15D are cross-sectional views of a recording drum and a light-exposure unit of FIG. 14, for explaining a focus adjusting mechanism.

FIGS. 15A to 15D show partial cross-sectional views of the process unit 63, and are used for explaining an adjustment of the focusing. FIG. 15A shows a case in which only the correction member 100*a* is inserted at a time of mounting the light-exposure unit, and there is no error in assembling and mounting the SELFOC lens 73*b* in unit 63.

Namely, a distance between the LED array unit 73*a* and an incident surface of the SELFOC lens 73*b* is L, a distance between the LED array unit 73*a* and an exit surface of the SELFOC lens 73*b* is A, and a distance between the exit surface and a surface of the recording drum 71 is L.

Figure 15B:
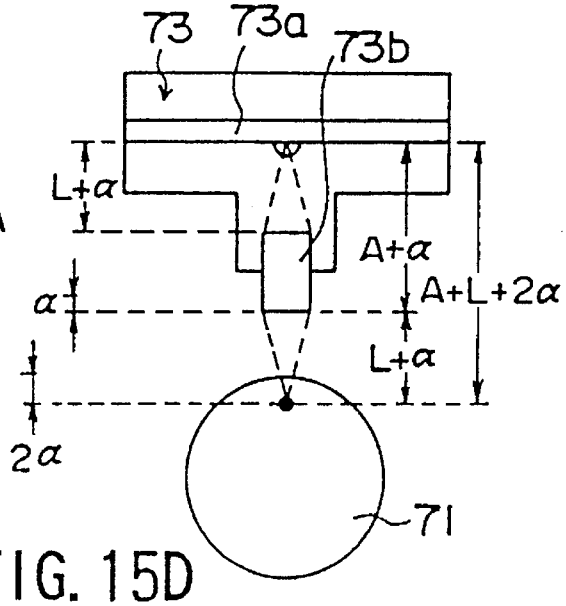
Figure 15C:
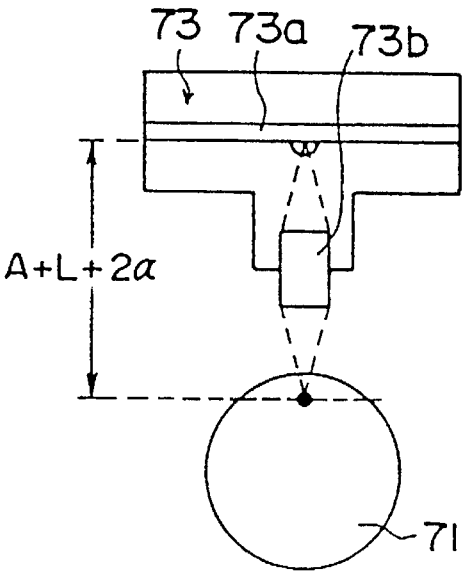

FIGS. 15B and 15C show a case in which there is an error in assembling and mounting the SELFOC lens 73*b* so that the distance from the LED array unit 73*a* to the exit surface of the SELFOC lens 73*b* is $A+\alpha$, instead of A. In this case, the focal length of the SELFOC lens 73*b* becomes $L+\alpha$, thereby the focus being inside the recording drum 71. Here, a distance between the LED array unit 73*a* and the focal point of the SELFOC lens 73*b* is $A+L+2\alpha$.

Figure 15D:
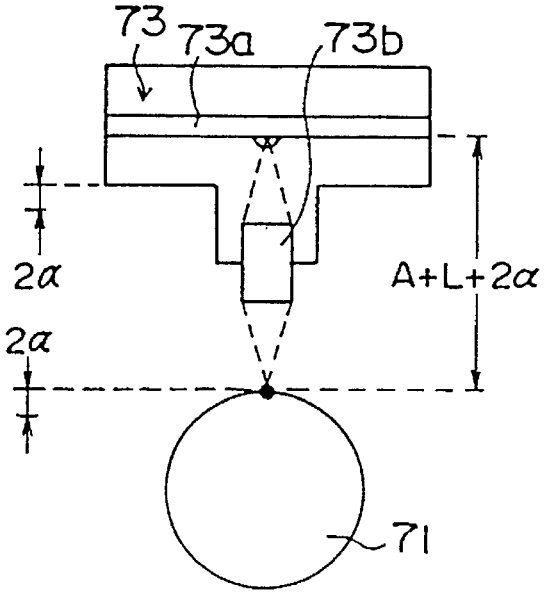

FIG. 15D shows an adjustment of the focusing. The adjustment is carried out by inserting the correction member 100*b* having the thickness of $2\alpha$ as shown in FIG. 14. In FIG. 15D, the focal point of the SELFOC lens can be placed on the surface of the recording drum 71 because of the insertion of the correction member 100*b*. The correction made by inserting a correction member is referred as a positive correction.

Figure 16:
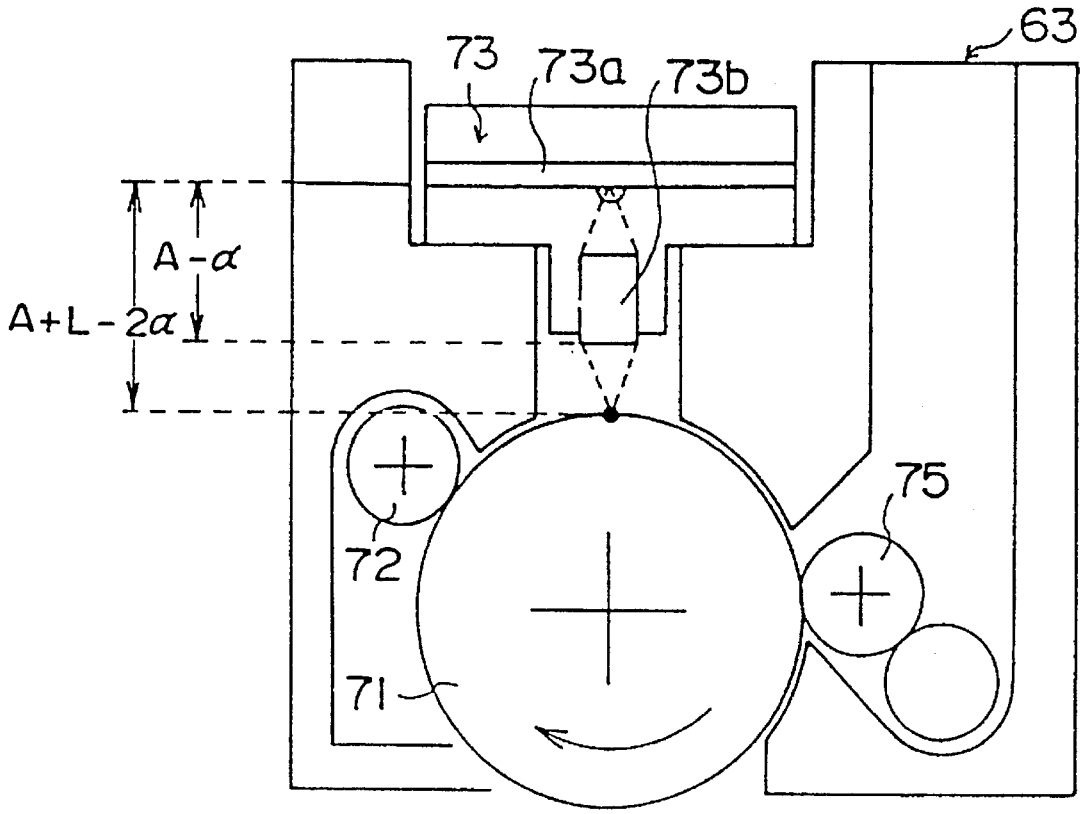
FIG. 16 is a cross-sectional view of the main part of FIG. 14, for explaining a focus adjusting mechanism.

FIG. 16 is another example of the adjustment of the focusing, and shows a case in which there is an error in assembling and mounting the SELFOC lens 73*b* so that the distance from the LED array unit 73*a* to the exit surface of the SELFOC lens 73*b* is $A-\alpha$, instead of A. In this case, a distance between the LED array unit 73*a* and the focal point of the SELFOC lens 73*b* becomes $A+L-2\alpha$. That is, the focal point would be positioned at a point in space if there was not any inserted correction member.

FIG. 16 shows a state in which the correction member 100*a* of FIG. 15A is removed. With the removal of the correction member 100*a*, the focal point of the SELFOC lens 73*b* is placed on the surface of the recording drum 71. As in this manner, the correction made by removing a correction member is referred as a negative correction.

For example, assume that a distance between the SELFOC lens 73*b* and the LED array unit 73*a* can be made within the assembly error $\alpha$ of $\pm 0.3$ mm. In this case, an amount of shift of the light-exposure unit 73 which is required for the adjustment of the focal point is $\pm 0.6$ mm. In order to realize appropriate focusing, two of the correction members 100*a* and 100*b* are inserted when $\alpha$ is greater than 0.1 mm, only a single correction member 100*a* is inserted when $\alpha$ is within a range between $-0.1$ mm and $+0.1$ mm, and no correction member is inserted when $\alpha$ is less than $-0.1$ mm. In this manner, the light-exposure unit 73 is mounted on the process frame 63*a*.

A required number of the correction members which should be inserted can be determined by measuring the distance A (i.e., a distance between the LED array unit 73*a* and the exit surface of the SELFOC lens 73*b*) or the distance L (i.e., a distance between the LED array unit 73*a* and the incident surface of the SELFOC lens 73*b*). Either of the measurements thus obtained can be recorded and displayed somewhere on each product of the light-exposure units 73. Classifying each product into different ranks can help the determination of the number of correction members to be inserted, when the light-exposure unit 73 is assembled in the process unit 63.

As described above, the adjustment of the number of the correction members used at the time of the assembly can result in the focal point of the SELFOC lens 73*b* being placed on the surface of the recording drum 71. Thus, the printing quality can be improved.

As described above, according to the first embodiment of the present invention, the angle adjustment means can adjust an angle of the light-exposure means so that the displacement observed between successive lines can be removed. Thus, the printing quality can be improved.

According to the second embodiment of the present invention, the cleaning means can be moved to rub (i.e., wipe) the surface of the light-exposure means, so that the dirt on the light-exposure means caused by the high-speed printing can be removed. Thus, the printing quality can be improved. Also, according to another example of the second embodiment, the cleaning means can be moved in the longitudinal direction of the light-exposure unit, providing a simple means for improving the printing quality.

According to the third embodiment of the present invention, the number of correction members inserted at the time of positioning the light-exposure means is adjusted so that the focal point of the light emitted by the light-exposure means can be readily placed on the surface of the image-holding body. Thus, the printing quality can be improved.

Further, the present invention is not limited to these embodiments, but various variations and modifications may be made without departing from the scope of the present invention.

What is claimed is:

1. An image forming device, comprising:

conveying means for conveying a recording sheet in a predetermined direction;

light-exposure means for emitting light from a light emitting surface thereof and forming an image on an image-holding body by using the emitted light, which image-holding body rolls on said recording sheet by rotating about an axis parallel to said predetermined direction and thereby transferring said image on said image-holding body onto said recording sheet; and cleaning means for cleaning said light-exposure means by moving relatively to, and in wiping contact with, the light emitting surface, the relative movement of said cleaning means being provided by said light-exposure means moving along with said image holding body for said transferring of said image onto said recording sheet.

2. The image forming device as claimed in claim 1, wherein the rolling of said image-holding body and the conveying of said recording sheet produce scans in first and second scanning directions, respectively, and thereby the formation of a complete image on said recording sheet.

3. The image forming device as claimed in claim 2, wherein said light-exposure means forms a latent image on said image-holding body.

4. The image forming device as claimed in claim 3, further comprising:

developing means for developing said latent image into a visible image on said image-holding body;

transfer means for transferring said visible image onto a recording sheet; and image-fixing means for fixing said visible image on said recording sheet.

5. The image forming device as claimed in claim 2, wherein said cleaning means further comprises manually operable means for manually driving said cleaning means for moving in wiping contact relatively to the light emitting surface.

6. The image forming device as claimed in claim 2, further comprising driving means for driving said cleaning means in said predetermined direction.

7. The image forming device as claimed in claim 2, further comprising hooking means provided at predetermined locations in said first scanning direction, wherein said light-exposure means, said image-holding body, and said cleaning means move together in said first scanning direction so that said cleaning means comes into contact with said hooking means and is displaced thereby for moving relatively to said light-exposure means and thereby cleaning said surface.

8. The image forming device as claimed in claim 7, wherein said hooking means are provided at a location near an ending point of said scans in said first scanning direction.

9. The image forming device as claimed in claim 7, wherein said hooking means are provided at one of a starting point and an ending point of said scans in said first scanning direction, and said cleaning means further comprises urging means for urging said cleaning means to an original position thereof when said cleaning means is displaced by said hooking means.

10. An image forming device, comprising:

conveying means for conveying a recording sheet in a predetermined direction;

light-exposure means for emitting light from a surface thereof and forming an image on an image-holding body by using the emitted light, which image-holding body rolls on said recording sheet by rotating about an axis lying in a plane parallel to said predetermined direction and thereby transferring said image on said image-holding body onto said recording sheet; and a correction member holder for receiving and holding correction members, inserted into the correction member holder when positioning said light-exposure means relative to said image-holding body and so that a focal point of said light impinges on said image-holding body.

* * * * *

UNITED STATES PATENT AND TRADEMARK OFFICE

CERTIFICATE OF CORRECTION

PATENT NO. : 5,612,767

DATED : Mar. 18, 1997

INVENTOR(S) : IWAMA

It is certified that error appears in the above-indentified patent and that said Letters Patent is hereby corrected as shown below:

Col. 1, line 32, after "19a and" insert --19b--.

Signed and Sealed this

Twenty-fourth Day of June, 1997

Bruce Lehman

*Attest:*

BRUCE LEHMAN

*Attesting Officer*

*Commissioner of Patents and Trademarks*